US008468924B2

(12) United States Patent
Skurdal et al.

(10) Patent No.: US 8,468,924 B2
(45) Date of Patent: Jun. 25, 2013

(54) STOWABLE ELEVATING TRAINABLE LAUNCHER (SETL)

(75) Inventors: Daniel A. Skurdal, Joppa, MD (US); John Snediker, Felton, PA (US); William Kalms, Baltimore, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 203 days.

(21) Appl. No.: 12/969,697

(22) Filed: Dec. 16, 2010

(65) Prior Publication Data

US 2012/0152092 A1 Jun. 21, 2012

(51) Int. Cl.
*F41F 3/04* (2006.01)

(52) U.S. Cl.
USPC ..... 89/1.819; 89/1.816; 89/1.815; 89/1.8; 89/1.801; 89/1.804; 89/1.805; 89/1.81

(58) Field of Classification Search
USPC ..... 89/1.819, 1.816, 1.815, 1.8, 1.801, 89/1.804, 1.805, 1.81
See application file for complete search history.

(56) References Cited

U.S. PATENT DOCUMENTS

| | | | | |
|---|---|---|---|---|
| 2,450,951 | A | 10/1948 | Goodhue et al. | |
| 2,745,317 | A | 5/1956 | Stanton et al. | |
| 2,870,678 | A | 1/1959 | Girouard et al. | |
| 2,995,986 | A | 8/1961 | Carlberg | |
| 3,002,428 | A | 10/1961 | Johnstone | |
| 3,044,362 | A | 7/1962 | Carlberg | |
| 3,048,087 | A | 8/1962 | Campbell | |
| 3,054,330 | A | 9/1962 | Carlberg | |
| 3,095,780 | A | 7/1963 | Bauer et al. | |
| 3,113,486 | A | 12/1963 | Kongelbeck | |
| 3,166,975 | A | 1/1965 | Landstrom et al. | |
| 3,173,334 | A | 3/1965 | Landstrom | |
| 3,215,040 | A | 11/1965 | Kossan et al. | |
| 3,222,988 | A | 12/1965 | Bull et al. | |
| 3,228,295 | A | 1/1966 | Kane et al. | |
| 3,331,279 | A | 7/1967 | Aldrin et al. | |
| 3,526,166 | A | 9/1970 | Pfister | |
| 3,534,653 | A | 10/1970 | Specht | |
| 3,545,837 | A * | 12/1970 | Chapman | 359/430 |
| 3,800,659 | A * | 4/1974 | Kuiper | 89/40.03 |
| 3,946,640 | A * | 3/1976 | Baumann | 89/1.815 |
| 4,444,087 | A * | 4/1984 | Hunter et al. | 89/1.802 |
| 4,637,292 | A * | 1/1987 | Peterson | 89/1.804 |
| 4,667,565 | A * | 5/1987 | Anderson | 89/36.08 |
| 4,708,052 | A * | 11/1987 | Argon | 89/41.01 |
| 5,020,412 | A | 6/1991 | Adams | |
| 6,526,860 | B2 * | 3/2003 | Facciano et al. | 89/1.801 |
| 6,691,600 | B2 | 2/2004 | Boudreau et al. | |
| 7,013,790 | B2 * | 3/2006 | Helms et al. | 89/38 |

(Continued)

*Primary Examiner* — Michelle Clement
(74) *Attorney, Agent, or Firm* — Kaplan Breyer Schwarz & Ottesen, LLP

(57) ABSTRACT

A system and method for launching non-vertical launch munitions with a non-vertical launch trajectory from a launcher that is operationally coupled to a vertical launching system (VLS). The inventors of the present invention recognized that munitions that are unsuitable for vertical launches were unavailable for use with vertical launching systems, thus foreclosing important defense, attack, and cost-savings opportunities for VLS-equipped platforms. A VLS could be substantially more versatile if it accommodated munitions such as torpedoes, counter-measures, direct-fire munitions, point-and-shoot munitions, and a variety of other missiles and equipment. The launcher according to the present invention is also stowable in an upward orientation within a cell of the host vertical launching system.

22 Claims, 9 Drawing Sheets

U.S. PATENT DOCUMENTS 7,032,493 B2 4/2006 Fowler
7,313,995 B2 * 1/2008 Shah et al. ..... 89/1.815
7,854,189 B1 * 12/2010 Fox ..... 89/1.804
2012/0152092 A1 * 6/2012 Skurdal et al. ..... 89/1.819

* cited by examiner

RETROFITTED MULTI-CELL LAUNCHER ("RMCL")
100

STOWABLE ELEVATING TRAINABLE LAUNCHER (SETL)

CROSS REFERENCE TO RELATED APPLICATIONS

The underlying concepts, but not necessarily the language, of the following case are incorporated by reference:

U.S. patent application Ser. No. 12/274,409, filed 20 Nov. 2008, titled "Adaptable Launching System," which published as U.S. Patent Application Publication No. 2009/0126556 A1 (attorney docket 711-239us).

If there are any contradictions or inconsistencies in language between this application and one or more of the cases that are incorporated by reference, the claims in the present case are to be interpreted consistent with the language in the present case.

FIELD OF THE INVENTION

The present invention relates to launching munitions in general, and, more particularly, to launching from a vertical launching system.

BACKGROUND OF THE INVENTION

Modern warships use guided missiles as their principal offensive and defensive weapons. Since a naval engagement may be protracted, a warship must have many missiles available for immediate launch. This need has been addressed by multiple-missile launchers, in which plural launch cells (e.g., eight cells, etc.) are loaded with missiles that can be individually launched. The need to launch missiles of different mission type from a single launcher has been met in part by vertical launching systems ("VLS"). A VLS launches missiles or other equipment with a vertical trajectory. A VLS is exemplified by the below-deck MK 41 VLS and MK 57 VLS missile launchers. These VLSs accept canisterized (or canistered) missiles of several types. The canisters are loaded into corresponding canister holding chambers or cells in the VLS. It should be noted that some VLS platforms have only one cell, while others have multiple cells.

A major roadblock to providing new munitions capability to naval fleets is the extremely high cost of modifications to the launching system. Integration of a new munition into an existing launching system typically requires the design and qualification of a new canister for the munition.

One solution that is beneficial to reducing the cost of integrating new munitions in existing main battery launchers is the "Adaptable Launch System" (hereinafter "ALS"). The ALS is described in U.S. patent application Ser. No. 12/274,409, filed on Nov. 20, 2008, which published as U.S. Patent Application Publication no. 2009/0126556 A1, titled "Adaptable Launching System," and which is incorporated by reference in its entirety herein. The ALS can be used as a "guest" launcher in one or more cells of a multi-cell "host" vertical launching system, such as the MK 41 VLS or MK 57 VLS main battery launchers. The ALS can accommodate a single munition or a "multi-pack" of smaller munitions in its single launch cell. Thus, the ALS enables a larger variety of munitions to be launched from a VLS.

However the advantages of the ALS do not address the particular needs of certain kinds of munitions.

SUMMARY OF THE INVENTION

The inventors of the present invention recognized that munitions that are unsuitable or sub-optimal for vertical launches were unavailable for use with vertical launching systems, thus foreclosing important defense, attack, and cost-savings opportunities for VLS-equipped ships (and other non-ship platforms). A VLS could be substantially more versatile if it accommodated munitions such as torpedoes, counter-measures, direct-fire munitions, point-and-shoot munitions, and a variety of other missiles and equipment. Likewise, an ALS could provide added flexibility if it could accommodate these types of munitions.

Embodiments of the present invention overcome some of the dichotomy between "non-vertical launch" equipment and a "vertical launch" platform such as a VLS.

The illustrative embodiment of the present invention is a "Stowable Elevating Trainable Launcher" (hereinafter "SETL"). The SETL is a launcher that accommodates non-vertical launch munitions and equipment and is capable of launching them from a VLS platform. As noted, non-vertical launch munitions are known in the art to be sub-optimal, and even unsuitable, for vertical launches.

The SETL can be retrofitted into a VLS cell, or in some embodiments, into an ALS operating in a VLS cell. In some embodiments, the VLS (whether equipped with an ALS or not) is an MK 41 VLS installed below the deck of a ship; in some other embodiments, the VLS is an MK 57 VLS. In some further embodiments, other VLS platforms (ship-borne and non-ship-based) host the SETL. In some further embodiments, the disclosed launcher system comprises a VLS. In some embodiments comprising the VLS, the VLS may be further equipped with an ALS in one or more cells.

The SETL comprises a munitions adapter and an elevation drive. The munitions adapter includes a munition frame structure that accommodates at least one munition. In some illustrative embodiments, the munition is canistered; however, in some alternative embodiments, the munition is not canistered. In some further embodiments, the munition frame structure comprises a firing tube that accommodates a single non-canistered torpedo. In still further embodiments, the munition frame structure accommodates all-up rounds. The munition frame structure, and, hence, the munitions adapter, is therefore specific to the particular type and dimensions of the launchable equipment being accommodated by the SETL.

The elevation drive enables the SETL to be stowed in a VLS cell when not in use and to deploy from the cell for use. The elevation drive is operatively coupled to the interior of the VLS cell and also to an upright support structure. The upright support structure supports and is pivotably coupled to the munition frame structure.

In some embodiments, the SETL has at least two degrees of rotational freedom for training a munition via elevation and azimuth control. The pivotal coupling of the munition frame structure to the upright support structure provides elevation control. That is, by pivoting the munition frame structure with respect to the upright support structure, the nose of the munition can be aligned to the proper non-vertical launch angle. Azimuth is controlled by rotating the upright support structure about its longitudinal axis. In some further embodiments, the SETL has limited elevation control that primarily enables the SETL to launch horizontally. In some further embodiments, azimuth control is limited or even absent. Thus, the number of degrees of freedom and the corresponding elevation and azimuth control characterizing a particular SETL embodiment depend on engineering decisions of the implementers.

To launch a munition when the SETL is in a stowed state, the elevation drive lifts the munition frame structure above the top hatchway of the VLS cell. In some illustrative embodiments, this means that the elevation drive lifts the munition frame structure to an above-deck position. After pivoting and rotating the munition frame structure to the proper elevation and azimuth, one or more missiles can be fired. Once the missile(s) is fired, the munition frame structure pivots to align with the longitudinal axis of the upright support structure. This allows the munition frame structure to fit within the VLS cell. The elevation drive then lowers the munitions adapter into the interior of the VLS cell.

In some embodiments, the SETL comprises a supporting shell structure that is dimensioned to fit within the VLS cell. The shell structure houses SETL components, such as the elevation drive and the munitions adapter, and accommodates SETL interfaces to the VLS. Such interfaces include a communications interface to the launch control system of the VLS or other governing weapons system.

In some embodiments, the SETL interfaces with an ALS that is equipped in the respective VLS cell. In such embodiments, the ALS acts as an intermediary between the SETL and the VLS cell.

The SETL thus provides a launcher that allows munitions to be integrated into a VLS without the expense and effort of modifying the munition or the host launching system. In the illustrative embodiments where the SETL is used in conjunction with a MK 41 VLS, the savings and streamlining advantages are significant. Further, by tapping the ship's existing electrical power system, some embodiments of the SETL do not require added power sub-systems dedicated to the non-vertical-launch munitions.

In addition to cost savings and streamlining, the SETL provides substantial versatility to MK 41 VLS and other VLS embodiments. For example, some prior-art systems operate from a below-deck configuration, such as a horizontal-launch system that operates below the deck of an aircraft carrier. See, e.g., U.S. Pat. No. 3.044,362 to R. E. Carlberg. Such systems are limited to launching only munitions with a substantially horizontal trajectory. These systems are incapable of launching from an initially vertical or vertically-stowed position, thereby lacking the capability of embodiments of the present invention wherein both vertical-launch and non-vertical launch munitions are launchable from the same main battery VLS platform.

Another advantage of the SETL is its footprint. Typically, prior-art launchers for non-vertical launch munitions are installed above-deck. See, e.g., U.S. Pat. No. 3,113,486 to S. Kongelbeck. In an illustrative embodiment wherein the VLS is a below-deck MK 41 VLS, the SETL occupies no footprint on the ship's deck. Consequently, the SETL in its stowed position has no identifiable radar cross-section.

Importantly, the SETL's stowed components are environmentally protected from harsh conditions outdoors or above-deck on a ship. The SETL components, including the munition frame structure and the elevation drive, as well as any munitions equipped in the SETL, are all protected and sealed within the VLS cell hosting the SETL. Optionally, these components can be subjected to additional special environmental conditions within the sealed VLS cell.

According to some illustrative embodiments, the SETL is a system for launching a munition that is a non-vertical-launch munition from a vertical launching system, the system comprising: an elevation drive that is operatively coupled at a first end thereof to the interior of a cell of the vertical launching system; and a munitions adapter that is operatively coupled to a second end of the elevation drive, wherein the munitions adapter comprises a munition frame structure that removably receives the munition; wherein the system is operable to (i) deploy the munition frame structure from within the cell to a position that is above a hatchway at the top of the cell, and (ii) pivot the munition frame structure between an upward orientation and a non vertical orientation, and (iii) launch the munition from the non-vertical orientation, and (iv) stow the munitions adapter in the upward orientation within the cell, wherein the upward orientation is parallel to a longitudinal axis of the cell; and wherein the system is adapted, arranged, and dimensioned to fit within the interior of the cell of the vertical launching system.

According to some embodiments, a method is disclosed for launching a munition that is a non-vertical launch munition from a vertical launching system, the method comprising: receiving, by a launcher, from a weapons system that is associated with the vertical launching system, a command to launch the munition, wherein the launcher is disposed in a cell of the vertical launching system; deploying from the cell, to a position above a hatchway at the top of the cell, a munition frame structure that removably receives the munition; pivoting, by the launcher, the munition frame structure between an upward orientation and a non-vertical orientation, wherein the upward orientation is parallel to a longitudinal axis of the cell; and launching the munition from the non-vertical orientation towards a launch direction.

DETAILED DESCRIPTION

The following terms are defined for use in this disclosure and in the accompanying claims:

"Operatively coupled" means that the operation of one element or device affects another device, wherein the devices need not be physically coupled. For example, a laser and a mirror are operatively coupled if a laser directs a beam of light to the mirror.

"Physically connected" or "physically coupled" means in direct physical contact and affixed (e.g., a mirror that is mounted on a linear motor).

"Vertical," in the context of a launch, means a direction that is perpendicular to the plane of the deck of a ship.

"Upward" or "Upwards" is used synonymously with "vertical" herein.

"Non-vertical," in the context of launch, means a horizontal or an acute-angle launch trajectory, such as might be associated with torpedoes, counter-measures, direct-fire munitions, point-and-shoot munitions, etc.

"Non-vertical launch munition" means a munition that is generally known in the art to be sub-optimal or unsuitable for vertical launches, such as a torpedo, a countermeasure, a direct-fire munition, a point-and-shoot munition, etc.

Turning now to the figures, it is to be understood that some structures and devices that are well-known in the art are not depicted in detail in the accompanying figures to maintain focus on elements that are germane to the present invention.

Figure 1:
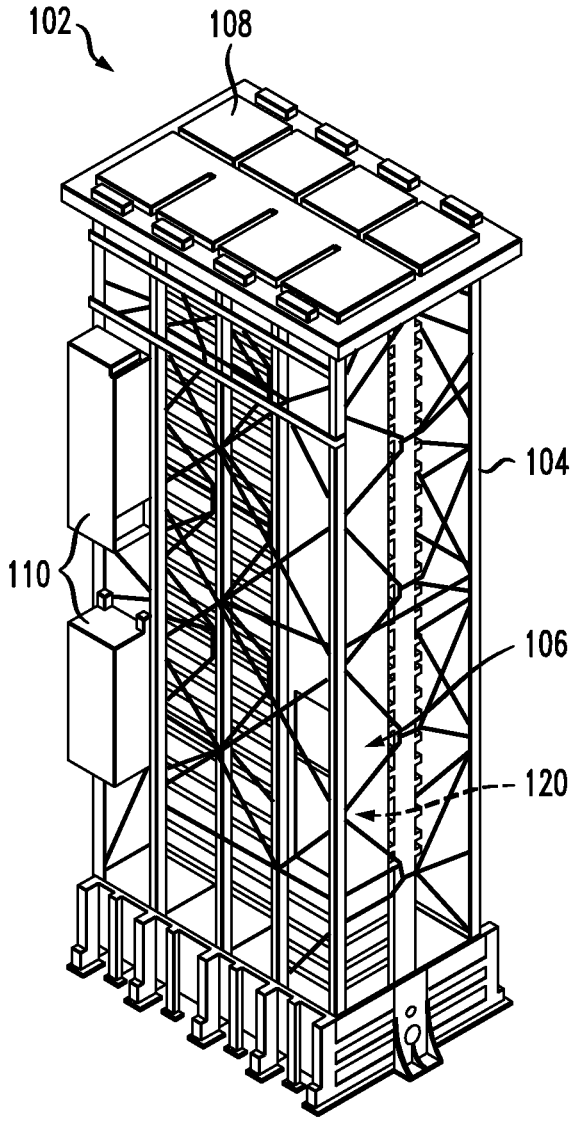
FIG. 1 depicts retrofitted multi-cell launcher ("RMCL") 100, which includes multi-cell multi-munition vertical launching system ("VLS") 102 and SETL 120.

FIG. 1 depicts retrofitted multi-cell launcher ("RMCL") 100, which includes multi-cell multi-munition vertical launching system ("VLS") 102 and SETL 120. In the embodiments depicted herein, VLS 102 is a MK 41 VLS main battery launcher that has been appropriately modified to operate with one or more SETL 120 units in its cells. SETL 120 is not visible in this view, because each SETL 120 unit is fully enclosed within a respective cell of VLS 102.

As depicted in FIG. 1, VLS 102 is a fixed vertical multi-missile storage and firing system. VLS 102 consists of an eight-cell missile module that is capable of launching a variety of different types of missiles. The eight-cell module comprises upright structure 104, which defines eight cells 106. In a conventional MK 41 VLS unit, each cell 106 provides vertical storage space for a missile canister. But in accordance with an illustrative embodiment of the present invention, one or more of cells 106 each receives a SETL 120 unit.

Figure 4:
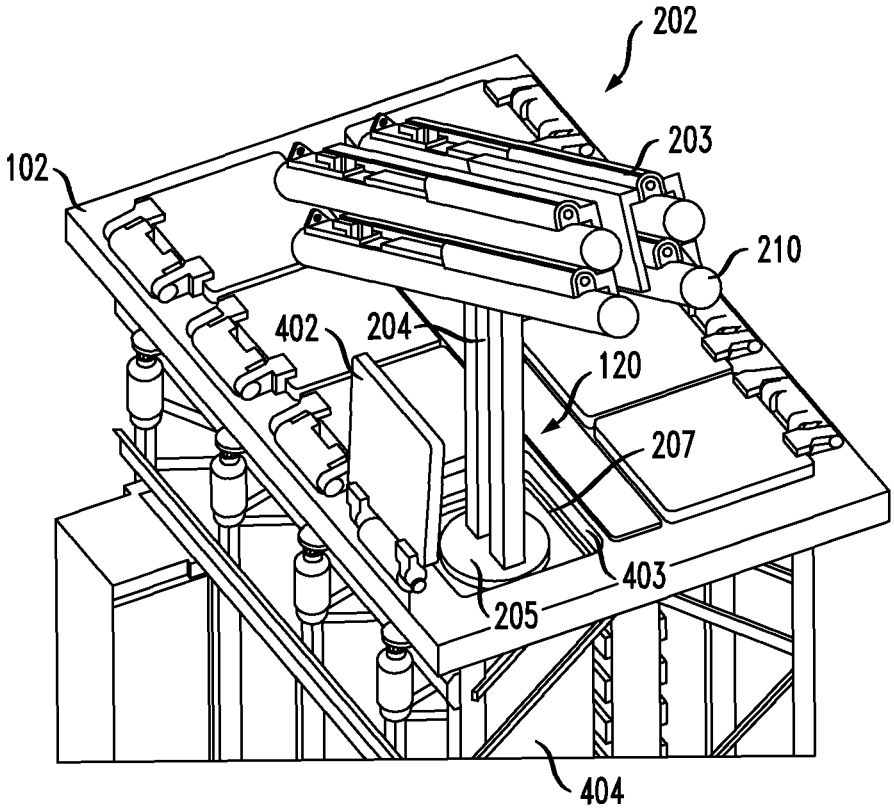
FIG. 4 depicts a deployed SETL 120.

The MK 41 VLS embodiment of VLS 102 is ship-borne and installed below deck, such that only deck and hatch assembly 108 is visible from the deck of the ship. Deck and hatch assembly 108 protects SETL 120 when stowed. The hatches in deck and hatch assembly 108 open to permit munitions launch, as illustrated in FIG. 4. It is to be understood that in alternative embodiments of the present invention the VLS hosting SETL 120 is not ship-borne. It is to be further understood that a VLS can have any number of cells, any number of which can each host a SETL 120 unit. It is to be further understood that a system according to the present invention does, in some embodiments, comprise a VLS and a SETL that is adapted, arranged, and dimensioned to fit within the interior of a cell of the VLS. Accordingly, some embodiments of such a system comprise a VLS with multiple cells, each cell being equipped with and operationally coupled to a SETL unit. Moreover, in some embodiments, each cell is further equipped with an ALS that hosts a SETL unit; in some such embodiments, the ALS comprises a supporting shell structure in which the SETL components are disposed and arranged.

Electronic equipment 110 monitors and controls various components of VLS 102, distributes power signals originating from outside RMCL 100 to the one or more SETL 120 units, collects control and damage control signals from SETL 120 and transmits them to appropriate authorities, and assists in the launch of munitions from SETL 120 units.

It is to be understood that in alternative embodiments an ALS is equipped within a cell 106 and the ALS is further modified with a SETL 120 unit. In such embodiments, the ALS acts as an intermediary between the SETL 120 unit and the VLS 102. In such embodiments, SETL 120 is adapted, arranged, and dimensioned to operate with the ALS that is installed in the VLS cell. In some alternative embodiments VLS 102 is an MK 57 VLS, but the invention is not so limited.

Figure 2:
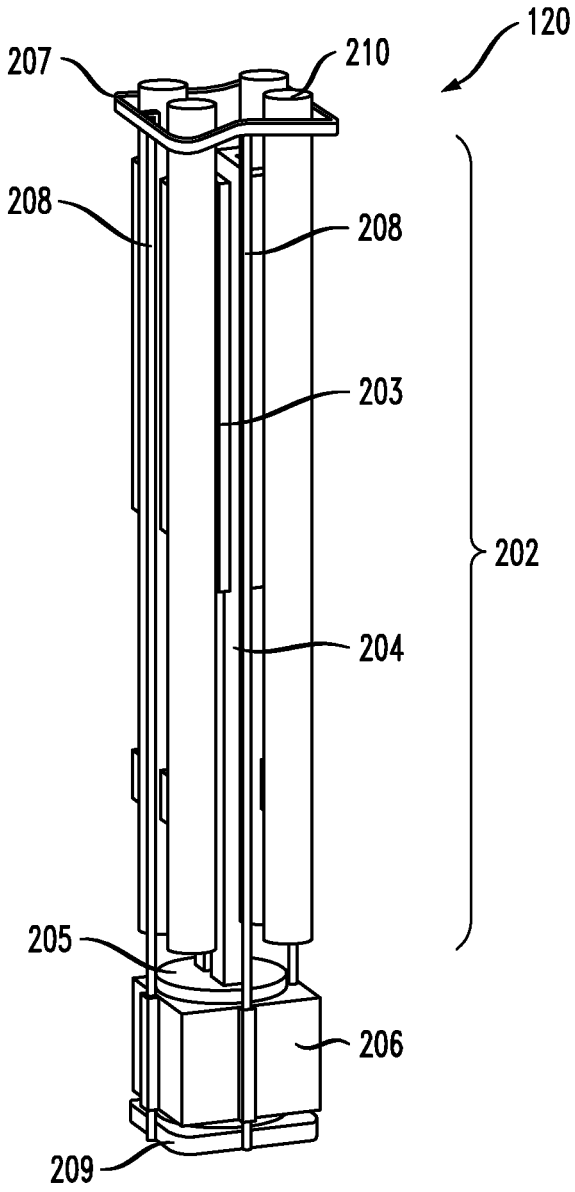
FIG. 2 depicts SETL 120 in a stowed position as it appears inside a VLS cell.

FIG. 2 depicts SETL 120 in a stowed position as it appears inside a VLS cell. It is to be understood that SETL 120 accommodates munition(s) 210, but the munitions are not an element of the SETL.

In the illustrative embodiment, SETL 120 comprises munitions adapter 202, column 205, elevation drive 206, frame 207, rails 208, and base 209.

Munitions adapter 202 comprises munition frame structure 203 and upright support structure 204. Munition frame structure 203 removably receives munition(s) 210 and is pivotably coupled to upright support structure 204 (as shown in more detail in the next figure). Munition frame structure 203 is dimensioned and adapted in accordance with particular munitions and is designed to be munition-specific. However, the invention is not so limited.

Upright support structure 204 supports munition frame structure 203. Upright support structure has a first end and a second end. The first end is pivotably coupled to munition frame structure 203 as recited above. The second end is coupled to column 205 as recited below.

Optionally, all or part of munitions adapter 202 is releasable from SETL 120 to enable the installation of munition(s) 210. In the illustrative embodiment, munition frame structure 203 is releasable from upright support structure 204. In other embodiments, munitions adapter 202 is releasable from SETL 120 in respect to another component of SETL 120, i.e., is releasable in a different place.

Column 205 supports upright support structure 204 and is physically coupled to the second end thereof, and thus indirectly supports munition frame structure 203. In the illustrative embodiment, column 205 rotates about its longitudinal (upright) axis. This axial rotation causes upright support structure 204 to rotate about its own longitudinal axis. Likewise, munition frame structure 203 also rotates. This enables SETL 120 to align the nose of an installed munition to a proper direction of launch, i.e., the axial rotation of column 205 provides SETL 120 with its rotational degree of freedom for azimuth control.

Elevation drive 206 is a sub-system that lifts and lowers munitions adapter 202 along the longitudinal axis of the VLS cell. In the illustrative embodiment, elevation drive 206 translates along rails 208 to lift and to lower munitions adapter 202. Elevation drive 206 also comprises the controls and control interfaces necessary for SETL's elevation and azimuth control capabilities. Elevation drive 206 is operationally coupled to the interior of the VLS cell. It is to be understood that elevation drive 206 is any system that is capable of lifting and lowering munitions adapter 202 and providing it with the necessary elevation and azimuth control. Elevation control is described in more detail below.

To launch in the illustrative embodiment, elevation drive 206 rises to a level sufficient to lift munition frame structure 203 above the top hatchway of the VLS cell, as shown in FIG. 4. In the illustrative embodiment where VLS 102 is below-deck, this means that elevation drive 206 lifts munition frame structure 203 to an above-deck position.

Frame 207 provides framing for positioning and supporting SETL 120 in a VLS cell. When SETL 120 comprises an optional shell structure 404, frame 207 is coupled to shell structure 404. (Shell structure 404 is illustrated in FIG. 4).

In the illustrative embodiment, rails 208 are guideways for elevation drive 206. In the illustrative embodiment, elevation drive 206 uses four stationary rails 208 to elevate and lower munitions adapter 202. Each rail 208 is disposed along a longitudinal side of SETL 120. Each rail 208 is attached at its top end to frame 207. Frame 207 thus helps stabilize rails 208 and elevation drive 206. In embodiments comprising an optional shell structure 404, rails 208 are affixed to shell structure 404. Alternative embodiments use a different number of rails 208 and a different structure for frame 207 to provide the positioning, support, and stabilization needed for SETL 120.

Base 209 is disposed at the bottom end of each rail 208. Base 209 supports rails 208 and thus helps stabilize rails 208 and elevation drive 206. Base 209 supports the other components of SETL 120. Furthermore, base 209 is coupled to optional shell structure 404, or to an ALS shell structure for ALS-equipped VLS cells; or is otherwise attached to the interior of the VLS cell where SETL 102 resides. Thus base 209 enables elevation drive 206 to be operationally coupled to the interior of the VLS cell.

FIG. 2 depicts four canistered munitions 210 installed in SETL 120. In some alternative embodiments, SETL 120 is equipped with a different type or a different number of munition(s) 210. Although the munitions 210 in the illustrative embodiment are canistered, other embodiments of SETL 120 can accommodate non-canistered munitions.

Figure 3:
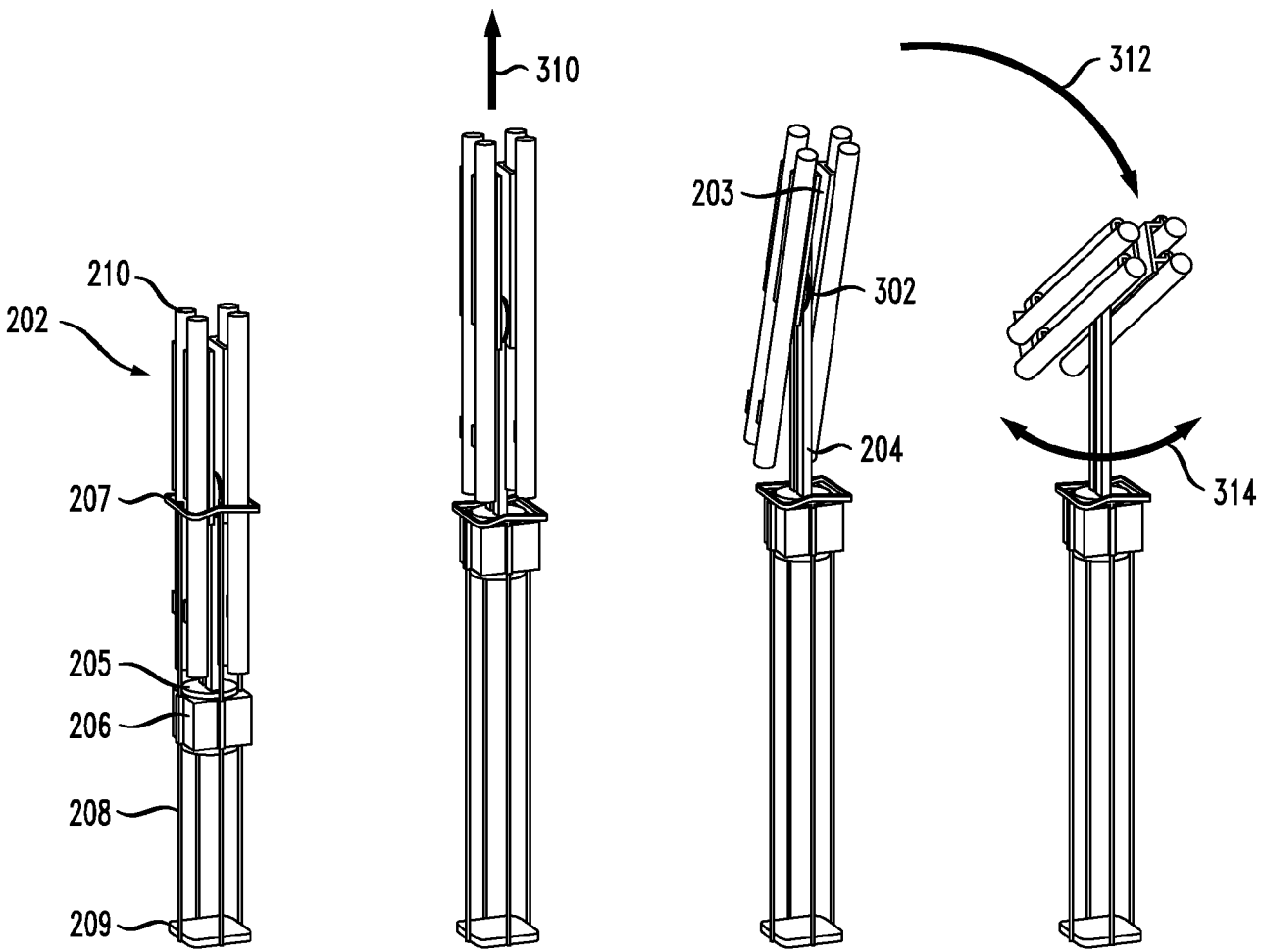
FIG. 3 depicts the operation of elevation drive 206 as it lifts munitions adapter 202 (equipped with munitions) and positions it for launch.

FIG. 3 depicts the operation of elevation drive 206 as it lifts munitions adapter 202 (equipped with munitions) and positions it for launch.

Viewing the present figure from left to right, first, elevation drive 206 lifts from base 209 along rails 208 in an upward direction 310. Installed munitions 210 and munitions adapter 202 (comprising munition frame structure 203 and upright support structure 204) are all in an upward orientation.

Next, when elevation drive 206 reaches the proper height it stops rising. The proper height depends at least in part on the dimensions of the munitions and on implementation choices relative to the design of the constituent components of SETL 120.

Next, SETL 120 pivots munition frame structure 203 about a pivot point, as indicated by directional arrow 312. The pivot point is represented in the illustrative embodiment by pivot assembly 302. Pivot assembly 302 provides the pivotable coupling of munition frame structure 203 to upright support structure 204.

Pivot assembly 302 provides SETL 120 with a rotational degree of freedom necessary to pitch munition 210 to its proper launch angle, i.e., elevation control. In some embodiments pivot assembly 302 pivots up to 180° from the upward orientation, but the invention is not so limited. By pivoting munition frame structure 203 with respect to upright support structure 204, the nose of an installed munition 210 can be aligned to the proper non-vertical launch angle.

Azimuth is controlled by rotating column 205 (and thus upright support structure 204) about its longitudinal axis as illustrated by directional arrow 314.

In the illustrative embodiment, the combination of (i) pivoting munition frame structure 203 about pivot assembly 302 and (ii) rotating column 205 about its longitudinal axis provides SETL 120 with the appropriate elevation and azimuth controls necessary to launch a munition 210 on a proper non-vertical trajectory. The rotational freedom thus available to SETL 120 provides significant versatility to the host VLS to launch a variety of different types of munitions and other equipment with unique non-vertical launch requirements. SETL 120 is capable of individually training and launching each munition 210 in munitions adapter 202. As noted, in some further embodiments, SETL 120 has limited elevation control that primarily enables the SETL to launch horizontally. In such an embodiment, SETL 120 performs primarily as a stowable horizontal launcher.

FIG. 4 depicts a deployed SETL 120. SETL 120 is shown with a fully elevated munitions adapter 202 having a munition frame structure 203 equipped with four canistered munitions 210.

Hatch 402 is part of a deck and hatch assembly in VLS 102. Hatch 402 is disposed over hatchway 403 at the top end of a cell in VLS 102. Hatch 402 opens to permit launch from the cell. When hatch 402 is closed, it provides a hatchway seal that protects SETL 120 and any installed munitions 210 that are stowed within the cell.

In some embodiments, SETL 120 further comprises an optional shell structure (or enclosure) 404 that is dimensioned to fit within a cell of VLS 102. Elevation drive 206, munitions adapter 202, and other components of SETL 120 are disposed within shell structure 404 to fit within the cell. It is to be understood that in an ALS-equipped VLS 102, the ALS provides a suitable shell structure for SETL 120 that takes the place of shell structure 404.

Figure 5:
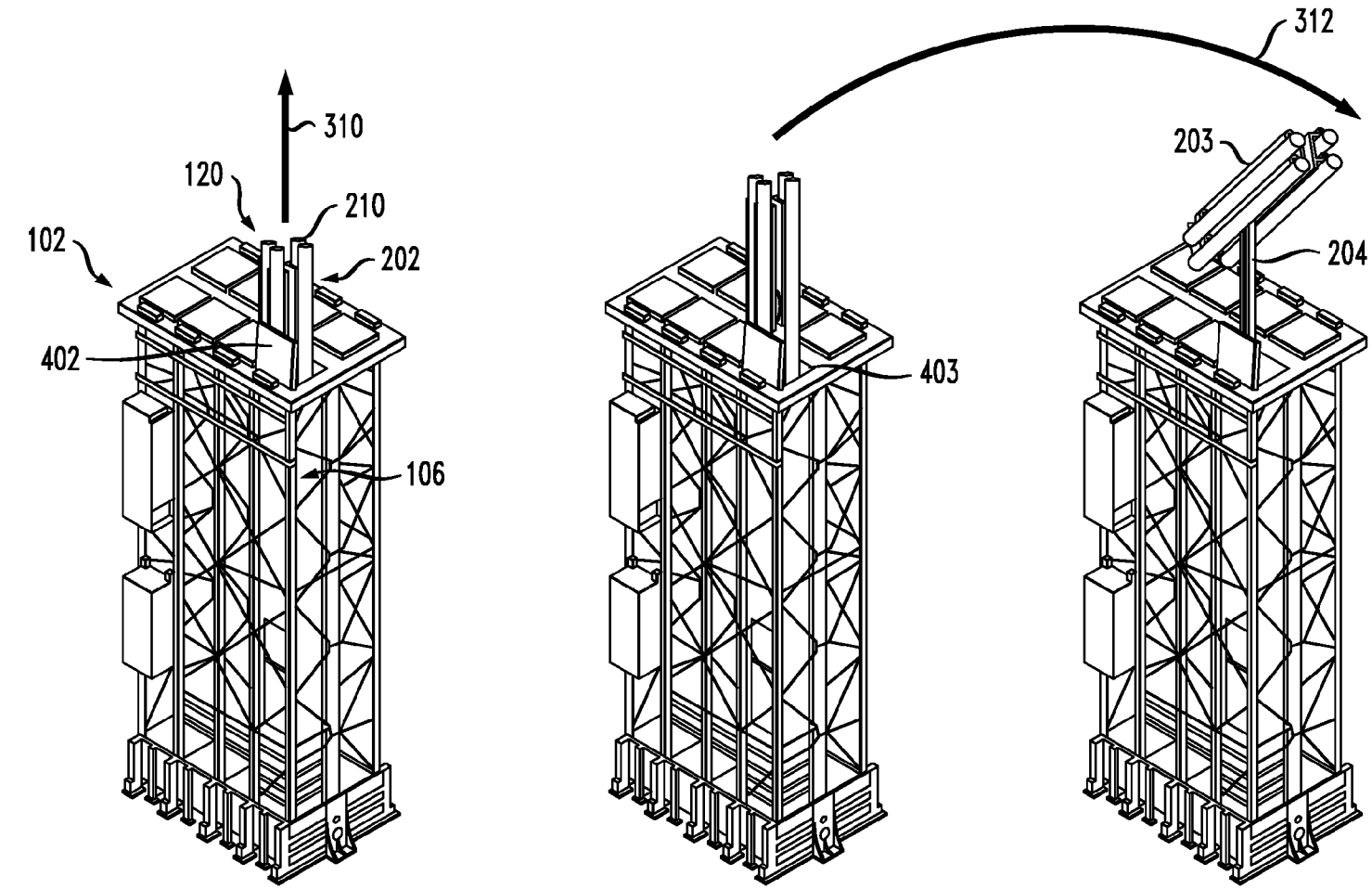
FIG. 5 depicts SETL 120 preparing to launch a munition 210.

FIG. 5 depicts SETL 120 preparing to launch an installed munition 210. Hatch 402 is in an open position to permit launch.

In the left-most image in the present figure, munitions adapter 202 rises from cell 106 of VLS 102 in an upward direction 310.

In the middle image of the present figure, SETL 120 raises munitions adapter 202 to a level sufficient to train and launch a munition 210. To do so, SETL 120 raises munitions adapter 202 such that munition frame structure 203 clears the top surface of VLS 102, i.e., is clear of hatchway 403. According to the illustrative embodiment where VLS 102 is installed below-deck, when munition frame structure 203 clears hatchway 403, munition frame structure 203 is in a position that is above-deck. At this point, SETL 120 is ready to train munition 210 to a proper launch trajectory.

In the right-most image of the present figure, SETL 120 trains a munition 210 for launch in a non-vertical trajectory. In the illustrative embodiment, SETL 120 pivots (according to directional arrow 312) munition frame structure 203 to an elevation angle that aligns the nose of the munition to the proper non-vertical launch angle suitable for the mission. For example, SETL 120 is capable of aligning munition 210 to the horizontal plane or to a substantially horizontal plane that is parallel to the plane of the deck of the ship. Further, SETL 120 rotates (as in FIG. 3) munitions adapter 202 to an azimuth that aligns the nose of the munition to a proper direction of launch.

Figure 6:
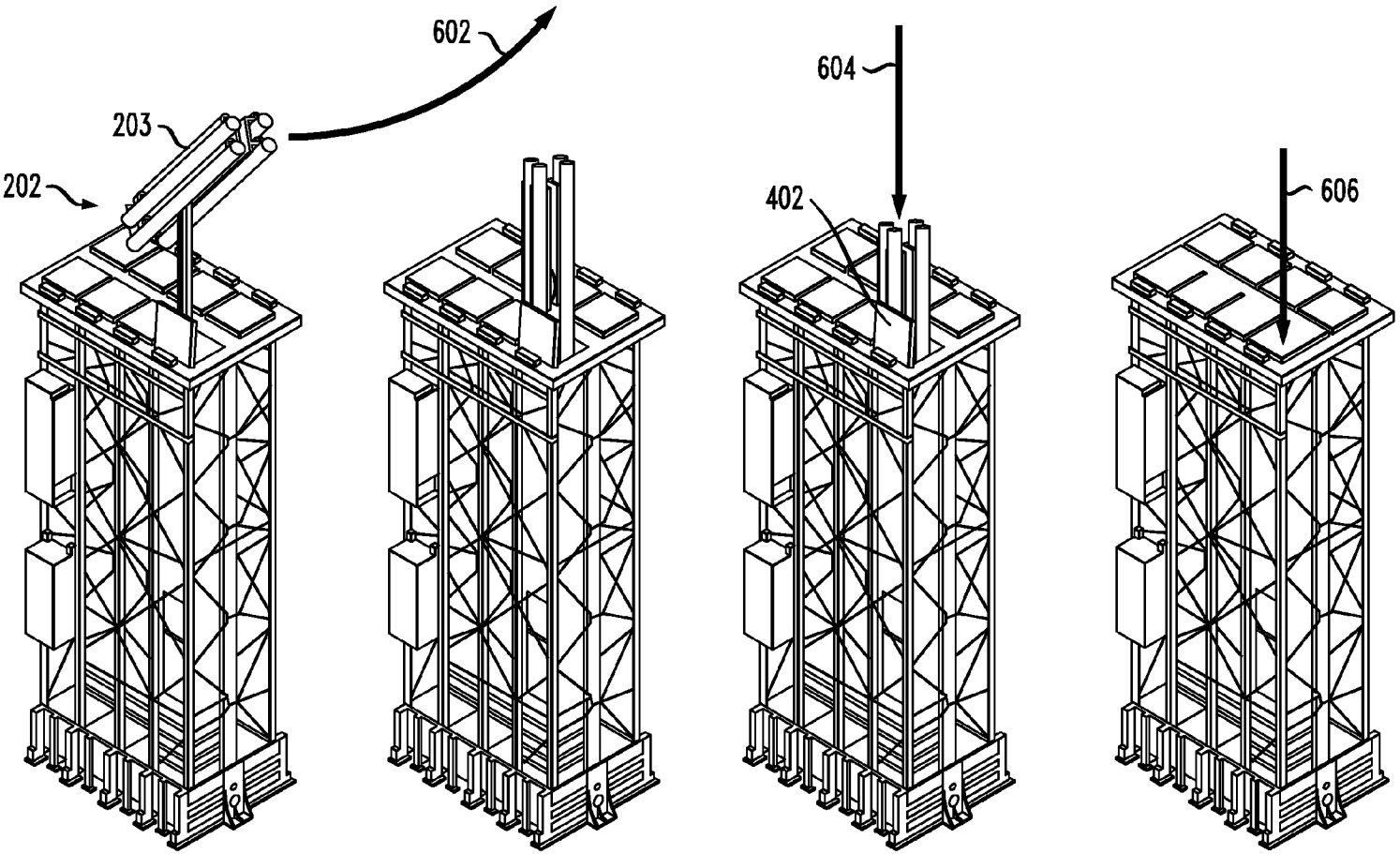
FIG. 6 depicts the stowing of SETL 120.

FIG. 6 depicts the stowing of SETL 120. When munition frame structure 203 is in a non-vertical launch orientation, it pivots (about pivot assembly 302) to an upward orientation as shown by directional arrow 602.

After munition frame structure 203 reaches the upward orientation, elevation drive 206 (not shown) begins to descend within the VLS cell. Thus, munitions adapter 202 is lowered, with munition frame structure 203 in its upward orientation, into the VLS cell according to directional arrow 604.

After munitions adapter 202 (with or without installed munitions) is fully lowered within the VLS cell, hatch 402 closes according to directional arrow 606 to seal SETL 120 within the cell. This protects SETL 120 (and any installed munitions) from the harsh environmental conditions above-deck. Moreover, while stowed and sealed, SETL 120 occupies no footprint on the ship's deck and provides no radar cross-section.

Although the illustrative embodiment recites operations in a certain sequence, it will be clear to those having ordinary skill in the art, after reading the present disclosure, that alternative sequences or sub-sequences are possible in accordance with the present invention. Although the illustrative embodiment comprises certain ratios of components relative to other components, such as a ratio of four rails to one elevation drive, it will be clear to those skilled in the art, after reading this disclosure, how to make and use alternative embodiments of the present invention that comprise any ratio of one type of component relative to any other type of component, e.g., two rails per elevation drive. It will be further clear to those having ordinary skill in the art, after reading the present disclosure, how to make and use alternative embodiments that use different combinations and sub-combinations of the recited components of SETL 120.

Figure 7:
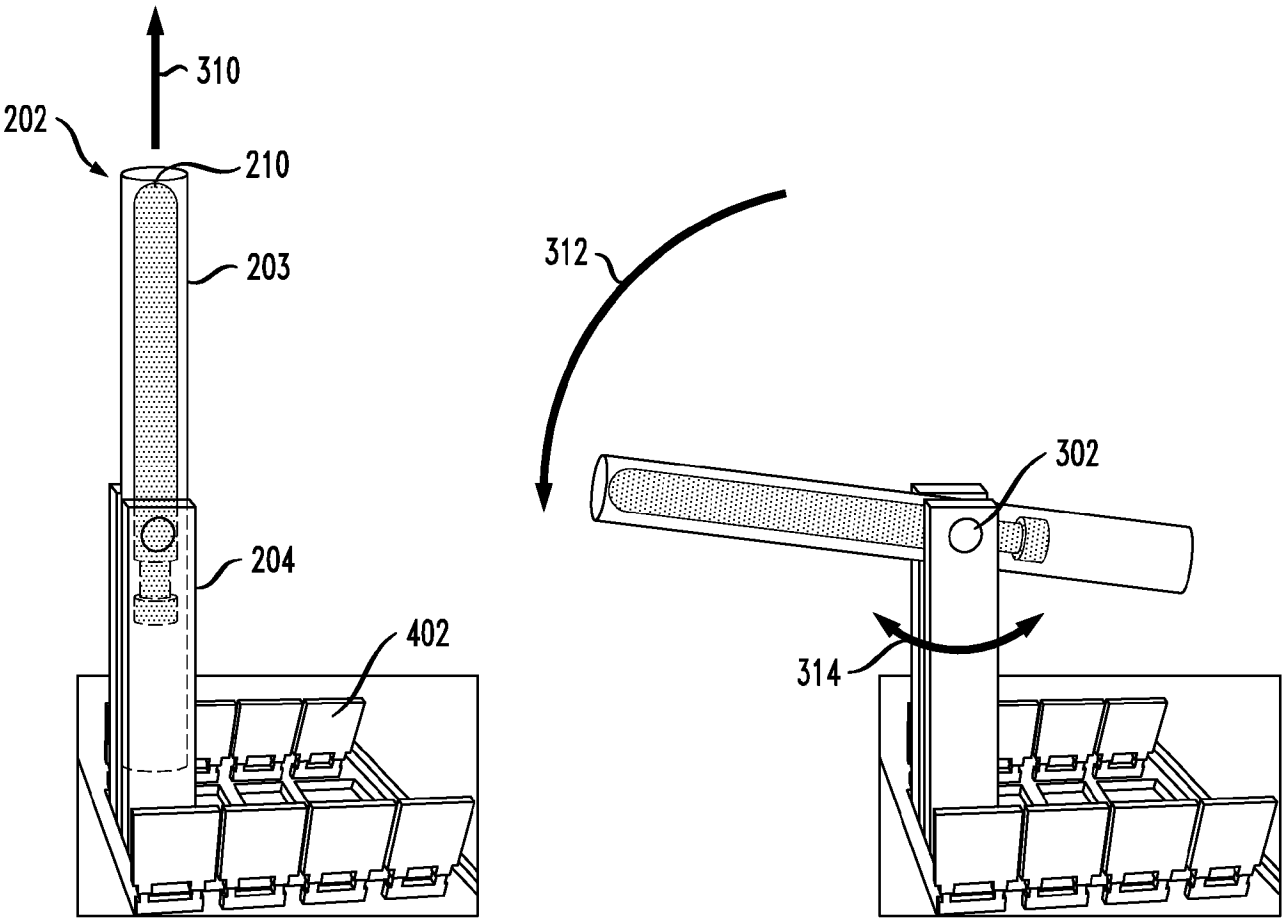
FIG. 7 depicts an alternative embodiment of munitions adapter 202 equipped with a non-canistered torpedo.

FIG. 7 depicts an alternative embodiment of munitions adapter 202 equipped with a non-canistered torpedo embodying munition 210. Munitions adapter 202 comprises munition frame structure 203 and upright support structure 204.

In this alternative embodiment, munition frame structure 203 is a firing tube adapted for launching a torpedo 210; upright support structure 204 is a lifting cradle. Lifting cradle 204 is pivotably coupled to firing tube 203 by "cradling" the tube's exterior. Firing tube 203 is raised in upward direction 310. Firing tube 203 pivots about pivot assembly 302 in direction 312 to reach a proper elevation for launching torpedo 210. Munitions adapter 202 rotates about the longitudinal axis of lifting cradle 204 for azimuth control as illustrated by directional arrow 314.

Figure 8:
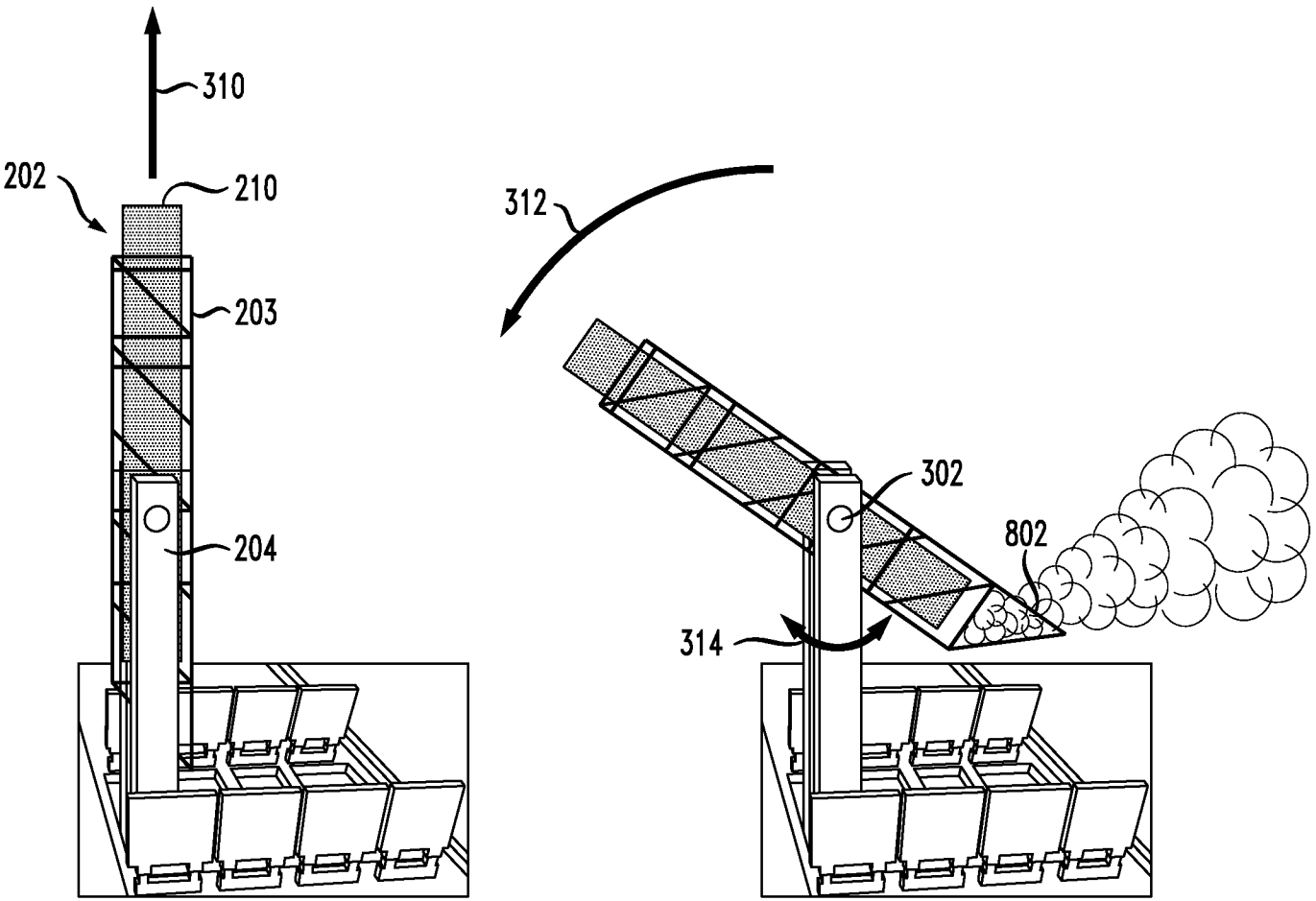
FIG. 8 depicts an alternative embodiment of munitions adapter 202 equipped with all-up rounds ("AUR").

FIG. 8 depicts depicts an alternative embodiment of munitions adapter 202 equipped with all-up rounds ("AUR") embodying munition 210. Munitions adapter 202 comprises munition frame structure 203 and upright support structure 204.

In this alternative embodiment, munition frame structure 203 is a frame assembly adapted for launching AUR 210. In this embodiment, the packaging and control interfaces of AUR 210 require no further modifications to operate with SETL 120; rather, frame assembly 203 is adapted to properly couple to and interface with the AURs. Upright support structure 204 is a lifting cradle. Frame assembly 203 is raised in upward direction 310. Frame assembly 203 pivots about pivot assembly 302 in direction 312 to reach a proper elevation for launching at least one of the AUR 210. Munitions adapter 202 rotates about the longitudinal axis of lifting cradle 204 for azimuth control as illustrated by directional arrow 314.

This alternative embodiment further illustrates an optional blast shield 802 that is coupled to one end of frame assembly 203. Blast shield 802 protects the ship's deck and any open VLS cells from the exhaust of the munitions being launched. It is to be understood that equipping SETL 120 with blast shield 802 is not limited to the illustrated embodiment.

Figure 9:
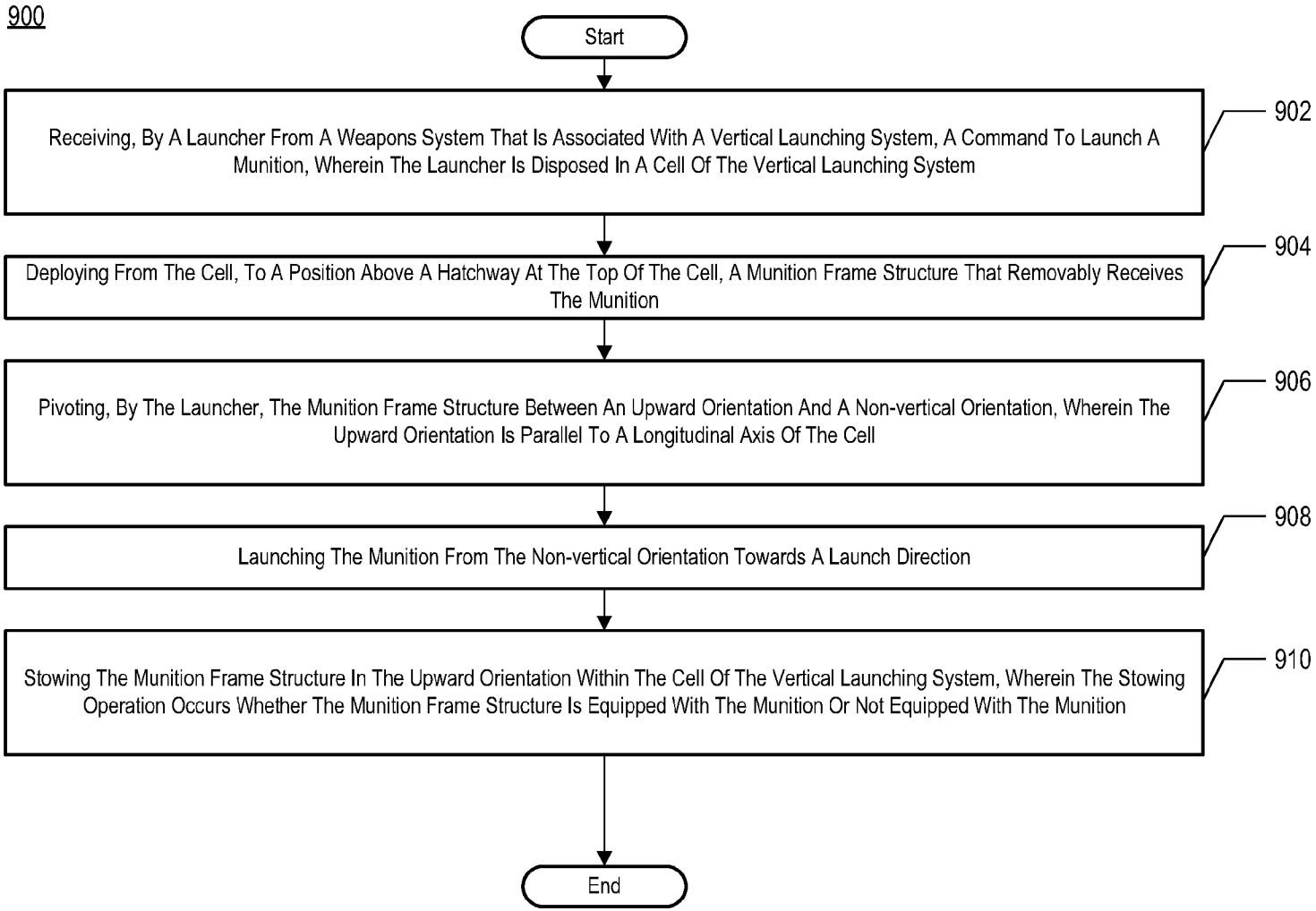
FIG. 9 presents method 900 in accordance with an illustrative embodiment of the present invention.

METHODS. FIG. 9 presents method 900 in accordance with an illustrative embodiment of the present invention. The method recites the operations that, in the context of a SETL 120 launcher installed in a cell of a VLS, are basic to deploying the SETL 120 launcher, launching a munition from the launcher, and stowing the launcher in the cell.

At operation 902, a launcher according to the present invention receives, from a weapons system that is associated with a VLS hosting the launcher, a command to launch a munition. In the illustrative embodiment, SETL 120 is disposed in a cell of MK 41 VLS that is ship-borne and installed below-deck. It will be clear to those having ordinary skill in the art how to interface MK 41 VLS (or any VLS) with the governing weapons systems and its control infrastructure. It will be further clear to those having ordinary skill in the art, after reading the present disclosure, that in alternative embodiments of the present invention the VLS hosting SETL 120 is not ship-borne.

At operation 904, a munition frame structure that removably receives a munition is deployed from the cell to an above-deck position. In the illustrative embodiment, munition frame assembly 203, having at least one munition installed, is deployed from a cell of MK 41 VLS.

At operation 906, the launcher pivots the munition frame structure between an upward orientation and a non-vertical orientation. In the illustrative embodiment, SETL 120 pivots munition frame structure 203 between the upward orientation (in which it initially deployed from the cell) and a non-vertical orientation, i.e., pivoting to the elevation that is necessary to launch the munition.

At operation 908, the launcher launches the munition from the non-vertical orientation towards a launch direction. In the illustrative embodiment, SETL 120 orients munitions adapter 202 to a direction of launch, i.e., azimuth, and launches the munition at the appropriate elevation and azimuth suitable to its mission.

At operation 910, the munitions adapter is stowed within the cell of the VLS (with or without munitions installed in the munition frame structure). In the illustrative embodiment, munitions adapter 202 is stowed with the cell of MK 41 VLS. Stowing can occur with or without munitions being installed in munition frame structure 203.

It will be clear to those having ordinary skill in the art, after reading the present disclosure, how to make and use a launcher according to method 900 in which the constituent operations are differently ordered than as recited herein. It will be further clear to those having ordinary skill in the art, after reading the present disclosure, how to make and use a launcher according to method 900 in which the constituent operations are sub-divided (or combined, or both) differently than as recited herein, or are repeated without limitation.

It will be clear to those having ordinary skill in the art, after reading the present disclosure, how to make and use alternative embodiments of the present invention that differently implement the principles and functions associated with the present invention. It is to be understood that the present disclosure teaches just some examples of the illustrative embodiment and that many variations of the invention can easily be devised by those skilled in the art after reading this disclosure and that the scope of the present invention is to be determined by the following claims.

What is claimed is:

1. A system comprising:

an an elevation drive that is operatively coupled at a first end thereof to the interior of a cell of a vertical-launching-system; and a munitions adapter that is operatively coupled to a second end of the elevation drive, wherein the munitions adapter comprises a munition-frame structure that removably receives a munition that is a non-vertical-launch munition;

wherein the system is operable to (i) deploy the munition-frame structure from within the cell of the vertical-launching system to a position that is above a hatchway at the top of the cell, and (ii) pivot the munition-frame structure between an upward orientation and a non-vertical orientation, and (iii) launch the munition from the non-vertical orientation, and (iv) stow the munitions adapter in the upward orientation within the cell of the vertical-launching system, wherein the upward orientation is parallel to a longitudinal axis of the cell; and wherein the system is adapted, arranged, and dimensioned to fit within the interior of the cell of the vertical-launching-system.

2. The system of claim 1 wherein the vertical-launching-system is ship-borne and installed below-deck, and wherein the position that is above the hatchway of the cell is above-deck.

3. The system of claim 1 wherein the system is operable to perform at least one of the deploy, pivot, and stow operations whether the munitions adapter is equipped with the munition or not equipped with the munition.

4. The system of claim 1 wherein the munition-frame structure is releasable from the system to receive the munition.

5. The system of claim 1 wherein the non-vertical orientation is perpendicular to the upward orientation.

6. The system of claim 1 wherein the munition is one of a plurality of non-vertical-launch munitions, and wherein the munition-frame structure is adapted and dimensioned to removably receive the plurality of non-vertical-launch munitions.

7. The system of claim 6 wherein the system is operable to launch the plurality of non-vertical-launch munitions from one or more non-vertical orientations.

8. The system of claim 1 wherein the vertical-launching-system is a modular below-deck multi-missile launching system.

9. The system of claim 1 wherein the vertical-launching-system comprises a plurality of cells.

10. The system of claim 1 further comprising:

a shell structure, wherein:

the elevation drive and the munitions adapter are disposed within the shell structure, and the shell structure is dimensioned to fit within the cell of the vertical-launching system.

11. The system of claim 1 wherein the the system is operable to launch the non-vertical-launch munition from the vertical-launching-system.

12. The system of claim 1 wherein the system is further adapted, arranged, and dimensioned to operate with an adaptable-launching-system that is installed in the cell of the vertical-launching-system.

13. A system comprising:

a vertical-launching-system;

an elevation drive that is operatively coupled at a first end thereof to the interior of a cell of the vertical-launching-system; and a munitions adapter that is operatively coupled to a second end of the elevation drive, wherein the munitions adapter comprises a munition-frame structure that removably receives a munition that is a non-vertical-launch munition;

wherein the system is operable to (i) deploy the munition frame structure from within the cell of the vertical-launching system to a position that is above a hatchway at the top of the cell, and (ii) pivot the munition frame structure between an upward orientation and a non-vertical orientation, and (iii) launch the munition from the non-vertical orientation, and (iv) stow the munitions adapter in the upward orientation within the cell of the vertical-launching system, wherein the upward orientation is parallel to a longitudinal axis of the cell; and wherein the (i) elevation drive and (ii) the munitions adapter are adapted, arranged, and dimensioned to fit within the interior of the cell of the vertical launching system.

14. The system of claim 13 wherein the system is operable to perform at least one of the deploy, pivot, and stow operations whether the munitions adapter is equipped with the munition or not equipped with the munition.

15. The system of claim 13 further comprising:

an adaptable-launching-system that comprises a shell structure, wherein the elevation drive and the munitions adapter are disposed within the shell structure, and wherein the adaptable-launching-system is disposed within the cell of the vertical-launching system.

16. The system of claim 13 wherein the vertical-launching-system is a modular below-deck multi-missile launching system.

17. The system of claim 13 wherein the system is ship-borne and installed below-deck, and wherein the position that is above the hatchway of the cell is above-deck.

18. A method comprising:

receiving, by a launcher, from a weapons system that is associated with a vertical-launching-system, a command to launch a munition that is a non-vertical-launch munition, wherein the launcher is disposed in a cell of the vertical-launching-system;

deploying from the cell of the vertical-launching-system, to a position above a hatchway at the top of the cell, a munition-frame structure that removably receives the munition;

pivoting, by the launcher, the munition-frame structure between an upward orientation and a non-vertical orientation, wherein the upward orientation is parallel to a longitudinal axis of the cell of the vertical-launching-system; and launching the munition from the non-vertical orientation towards a launch direction.

19. The method of claim 18 further comprising:

stowing the munitions adapter in the upward orientation within the cell of the vertical-launching-system, wherein the stowing operation occurs whether the munitions adapter is equipped with the munition or not equipped with the munition.

20. The method of claim 19 wherein the stowing of the munitions adapter comprises pivoting the munitions adapter to the upward orientation.

21. The method of claim 18 wherein at least one of the receiving, deploying, and pivoting operations occurs whether the munitions adapter is equipped with the munition or not equipped with the munition.

22. The method of claim 18 wherein the vertical-launching-system is ship-borne and installed below-deck, and wherein the position that is above the hatchway of the cell is above-deck.

* * * * *